US007163275B2

(12) United States Patent
Yeh et al.

(10) Patent No.: US 7,163,275 B2
(45) Date of Patent: Jan. 16, 2007

(54) METHODS AND APPARATUS FOR AN AUTOMATIC FLUID EJECTOR ALIGNMENT AND PERFORMANCE SYSTEM

(75) Inventors: Andrew S. Yeh, Portland, OR (US); Roger G. Markham, Webster, NY (US); Lesley P. Dudek, Webster, NY (US); Eduardo M. Freire, Kennett Square, PA (US); Gary A. Kneezel, Webster, NY (US); Christopher R. Morton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 268 days.

(21) Appl. No.: 10/752,717

(22) Filed: Jan. 8, 2004

(65) Prior Publication Data

US 2005/0151767 A1 Jul. 14, 2005

(51) Int. Cl.
*B41J 29/38* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 4,463,359 | A | 7/1984 | Ayata et al. | |
| 5,160,403 | A | 11/1992 | Fisher et al. | |
| 5,521,620 | A * | 5/1996 | Becerra et al. | 347/14 |
| 6,454,380 | B1 | 9/2002 | Endo | |
| 6,549,226 | B1 * | 4/2003 | Shimizu et al. | 347/241 |
| 6,585,346 | B1 * | 7/2003 | Endo | 347/19 |
| 6,604,807 | B1 * | 8/2003 | Murcia et al. | 347/19 |
| 6,609,777 | B1 | 8/2003 | Endo | |
| 2002/0018090 | A1 * | 2/2002 | Takazawa et al. | 347/19 |
| 2002/0140756 | A1 * | 10/2002 | Kuriyama et al. | 347/19 |
| 2002/0180824 | A1 * | 12/2002 | Endo | 347/19 |
| 2003/0156148 | A1 * | 8/2003 | King et al. | 347/19 |
| 2003/0202040 | A1 * | 10/2003 | Shade | 347/40 |
| 2003/0227517 | A1 * | 12/2003 | Yaron | 347/51 |

FOREIGN PATENT DOCUMENTS

JP 2000263772 A * 9/2000

* cited by examiner

*Primary Examiner*—Manish S. Shah
*Assistant Examiner*—Laura E. Martin
(74) *Attorney, Agent, or Firm*—Oliff & Berridge, PLC

(57) ABSTRACT

Methods and apparatus provide for automatic fluid ejector alignment and performance evaluation and modification in one or multiple planes. A fluid ejector fires a drop through a drop detection module. A signal indicating drop presence or absence is sent to a computer. The computer analyzes the data, and makes a compensation determination of a preferred method of using the fluid ejector. The compensation determination may include electronically modifying the image data to be printed, physically manipulating the fluid ejector, completely skipping the fluid ejector during printing operations, or in some other way modifying the fluid ejector or image data such that apparent printed image error due to fluid ejector alignment or performance error is reduced.

27 Claims, 14 Drawing Sheets

METHODS AND APPARATUS FOR AN AUTOMATIC FLUID EJECTOR ALIGNMENT AND PERFORMANCE SYSTEM

BACKGROUND OF THE INVENTION

1. Field of Invention

This invention relates to methods and apparatus for an automatic fluid ejector alignment and performance system that has the ability to determine alignment and operation of at least one fluid ejector, and can provide various implementation methods to modify defects or errors in operation.

2. Description of Related Art

Fluid ejector systems, such as drop-on-demand liquid ink printers, including piezoelectric, acoustic, phase change wax-based or thermal printers, have at least one fluid ejector from which drops of fluid are ejected towards a receiving sheet. Within the fluid ejector, the fluid is contained in a plurality of channels. Power pulses cause the droplets of fluid to be expelled as required from orifices or nozzles at the end of the channels.

When the fluid ejector is an ink jet printhead, the fluid ejector may be incorporated into for example, a carriage-type printer, a partial width array-type printer, or a page-width type printer. The carriage-type printer typically has a relatively small printhead containing the ink channels and nozzles. The printhead can be functionally attached to a disposable ink supply cartridge. The combined printhead and cartridge assembly is attached to a carriage that is reciprocated to print one swath of information at a time, on a stationary receiving medium, such as paper or transparencies, where each swath of information is equal to the length of a column of nozzles.

Conventional printing systems step the receiving medium a distance generally equal to or less than the height of the swath to be printed, so that the next printed swath is contiguous or overlaps with the previously printed swath. When there is no data to print in large blocks, the receiving medium may be stepped a larger amount. This procedure is repeated until the entire image is printed.

Optimal performance of a fluid ejector requires the nozzles be properly aligned. When the fluid ejector is a color ink jet printhead, such as a four color printhead (CMYK), proper alignment of the various color heads is necessary and printed test patterns are generally used. Each alignment procedure, including vertical head to head alignment, horizontal head to head alignment, bi-directional alignment, and tilt alignment, requires four test pattern sets to be run for a four printhead printer. Furthermore, if the printhead carriage operates at multiple speeds, such as draft and normal, test pattern sets for some alignment procedures must be run for each speed. Manual procedures for correcting alignment require considerable user labor and are prone to user error. These procedures require the user to run the test pattern sets, visually observe the test pattern sets, visually judge the optimal test pattern set among various alternatives, and choose an adjustment value.

Automatic alignment procedures are also known. U.S. Pat. No. 6,609,777 B2 to Endo, the disclosure of which is incorporated herein by reference in its entirety, discloses technology for printing and determination of an adjustment value for correcting bi-directional misalignment of the dot recording positions. The printing apparatus includes an inspection unit that optically detects the passage of a continuous stream of ink droplets ejected from a printer nozzle. An adjustment value is determined based on the results of the performance of a forward pass test and a reverse pass test, and bi-directional misalignment can be determined without need for human observation.

Fluid ejector system's performance will also be impacted by a fluid ejector's nozzle performance. When the fluid ejector is in an ink jet printhead, fluid ejector performance may be impacted where particle contamination clogs the nozzle, where kogation of the heaters decreases drop velocity, or where damage occurs to the nozzle, such as due to resistor burn-out, or where the printhead brushes against the print medium, or where the nozzle plate becomes worn due to frequent servicing. Other factors may also impact nozzle performance. Fluid ejector performance is often determined by printing a test pattern and visually inspecting the test pattern results.

Automatic methods for detecting fluid ejector performance are also known. U.S. Pat. No. 6,454,380 B1 to Endo, the disclosure of which is incorporated herein by reference in its entirety, discloses a system for inspecting nozzles requiring the jetting of a continuous stream of ink droplets for detecting the clogging of nozzles in a printer wherein timings for printing operations for conducting the inspection are preset with respect to at least two print modes. Similarly, U.S. Pat. No. 6,585,346 B2 to Endo, the disclosure of which is incorporated herein by reference in its entirety, discloses a technique for detecting the presence or absence of inoperative nozzles by comparing a specific threshold with a time interval between successive detection pulses. Similarly, U.S. Pat. No. 6,604,807 to Murcia, the disclosure of which is incorporated herein by reference in its entirety, discloses a method for determining anomalous nozzles in an ink jet printing device.

SUMMARY OF THE INVENTION

Current fluid ejector alignment and performance techniques for determining and modifying fluid ejector alignment and performance have significant disadvantages. For example, a large number of test pattern sets are required to be printed. The user then visually analyzes the test pattern sets and manually enters a value into a computer to modify the fluid ejector alignment or performance. Because of the user involvement, the method is onerous, time-consuming, and prone to error. Thus, the conventional method often has inconsistent results in both determining and modifying fluid ejector alignment and performance.

The methods and apparatus of this invention provide for automatic fluid ejector alignment and performance evaluation and modification in one or multiple planes.

The methods and apparatus of this invention separately provide an automatic fluid ejector alignment and performance evaluation that can determine properties on an individual nozzle basis.

In various exemplary embodiments, a fluid ejector fires a fluid drop through a laser beam emitted from a drop detection module's laser. A shadow is created on the drop detection module's photodiode if the fluid drop impinges the laser beam. A shadow is not created if the firing of the drop either fails to eject a fluid drop, or the fluid drop fails to impinge the laser beam. The shadow or lack of shadow signal is focused by a microscope through an aperture onto a photodiode. The microscope is not essential to the invention and the removal of the microscope will result in a simpler apparatus.

In various exemplary embodiments, the focus of the shadow or lack of shadow on the photodiode is amplified by an amplifier and converted into a signal. The signal is sent to a computer as data. After analyzing the data, the computer makes a compensation determination which may then be applied to the fluid ejector to electronically modify the image data to be printed, physically manipulate the fluid ejector nozzle, completely skip the fluid ejector during printing operations or in some other way modify the fluid ejector or image data such that error in the printed image due to fluid ejector mis-alignment or performance error is reduced.

Throughout this application, the decision by the computer on how to modify the fluid ejector such that error induced by the fluid ejector on the printed image is reduced, will be referenced to collectively as the compensation determination. Among other determinations, the computer may make a compensation determination to modify the image data to be printed, to physically manipulate a fluid ejector, or to completely skip a fluid ejector during the printing process.

The compensation determination determines the preferred method of using the selected fluid ejectors to create the printed image. An example of a compensation determination to modify an image to be printed in order to correct for fluid ejector alignment or performance errors may include rotating an image. Similarly, a determination to physically manipulate a fluid ejector in order to compensate for error may include wiping or priming a fluid ejector, or changing the voltage to a fluid ejector.

In various exemplary embodiments, the compensation determination may be made by an on-board diagnostic tool, such as a controller, that allows the apparatus to self-check and modify fluid ejector metrics on a regular basis.

Other objects, advantages and features of the invention will become apparent from the following detailed description taken in conjunction with the attached drawings, which disclose exemplary embodiments of the invention.

BRIEF DESCRIPTION OF THE DRAWINGS

The invention will be described with reference to the following drawings in which like reference numerals refer to like elements and wherein.

DETAILED DESCRIPTION OF PREFERRED EMBODIMENTS

The following detailed description of various exemplary embodiments of the fluid ejection systems according to this invention may refer to one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Figure 1:
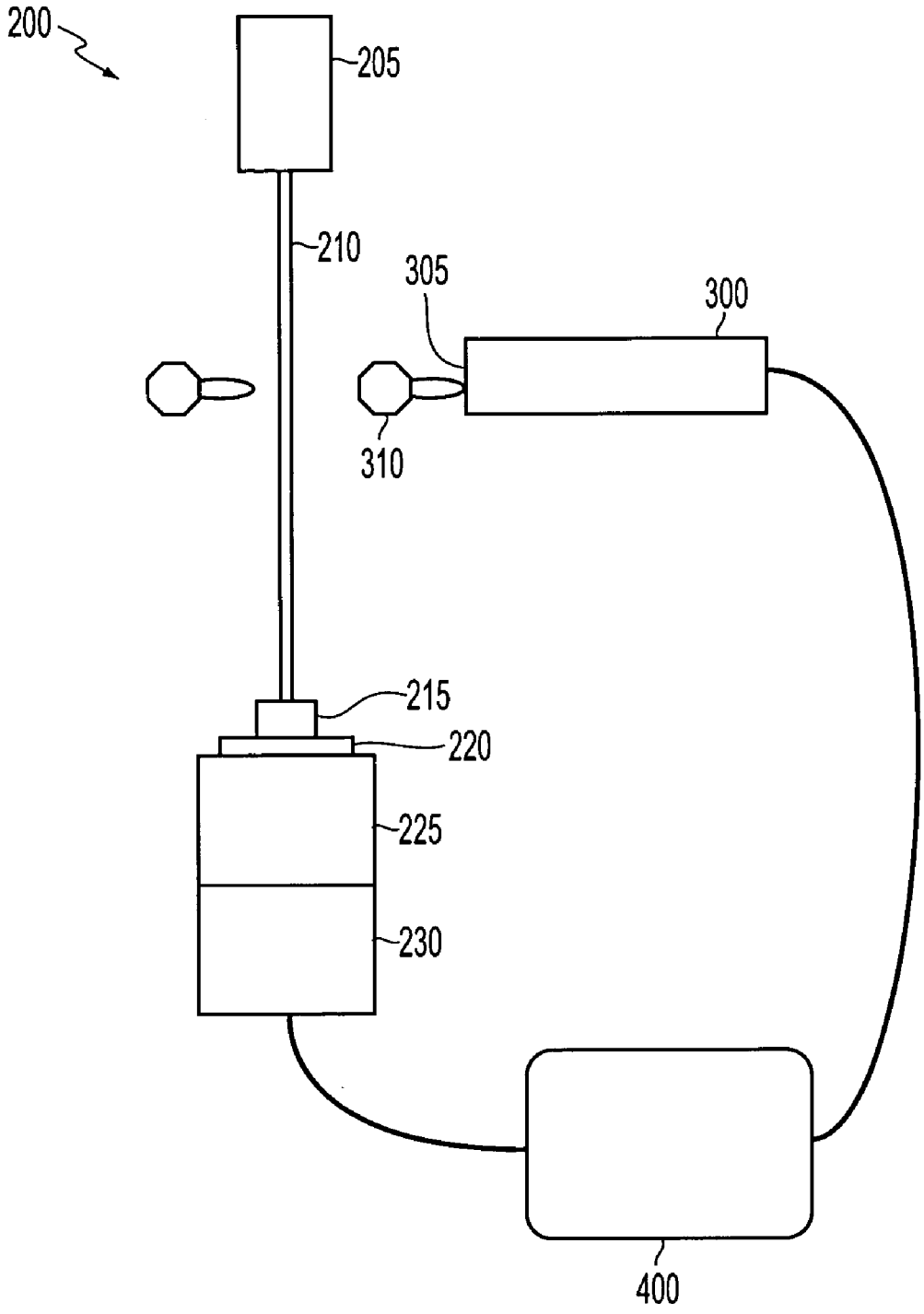
FIG. 1 illustrates one exemplary embodiment of a fluid ejector system drop detection module according to the invention.

FIG. 1 shows an exemplary embodiment of a fluid ejector system drop detection module 200 that incorporates the systems and methods of the invention. A fluid ejector or emitter 305 is housed in a printhead 300. A computer 400 signals the laser 205 to fire a drop detection module laser beam 210. The computer 400 may also signal the printhead 300 to fire a drop 310 from fluid ejector 305. A microscope 215 captures the laser beam 210 and focuses the laser beam 210 through an aperture 220 onto a photodiode 225. The signal from the photodiode 225 may be amplified by amplifier 230 and sent to the computer 400. The drop detection module 200 and its components are provided to detect the passage of individual drops 310 from emitter 305 for purposes of alignment and/or performance monitoring.

Figure 2:
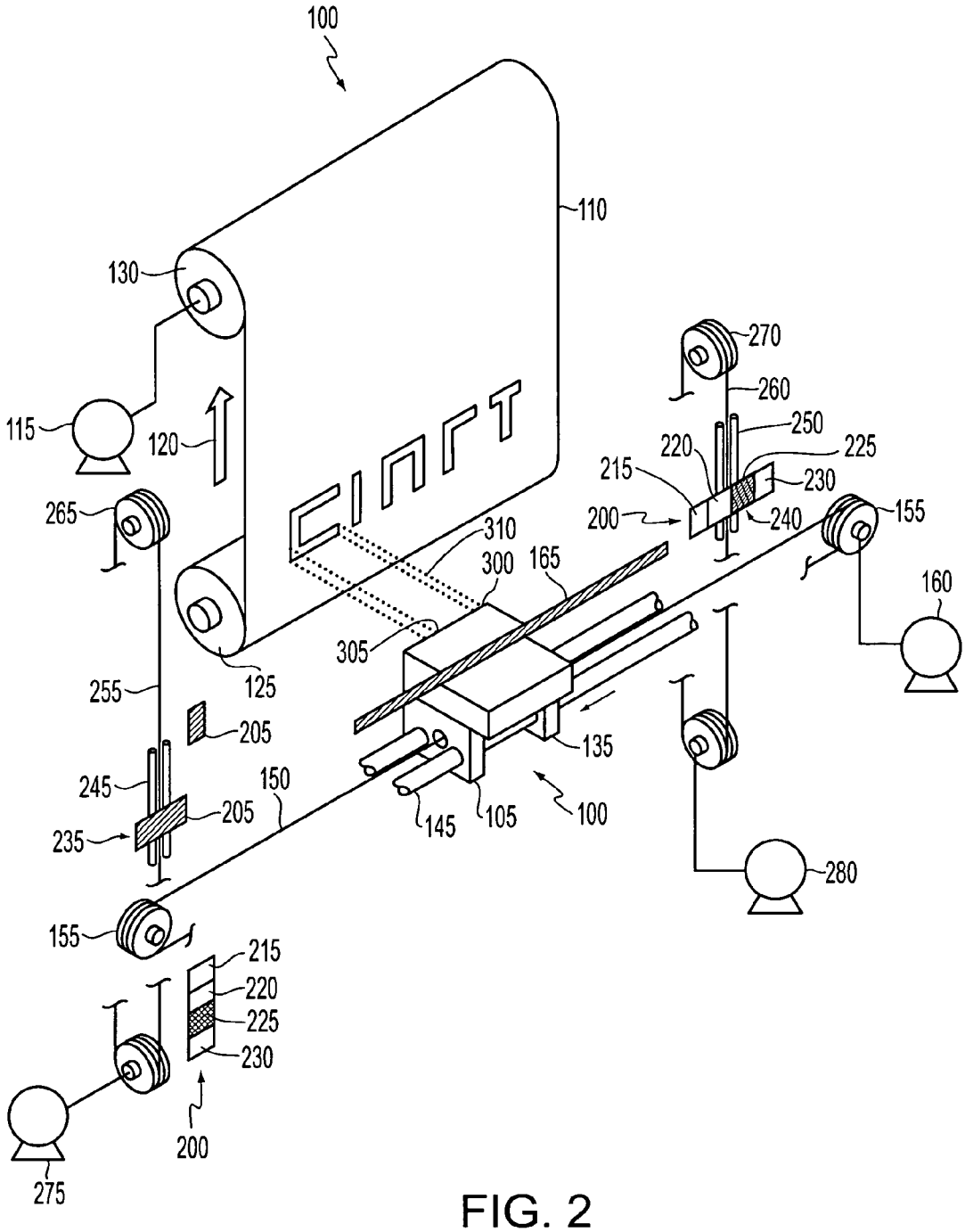
FIG. 2 illustrates one exemplary embodiment of a fluid ejector device usable with various exemplary systems and methods according to this invention.
Figure 3:
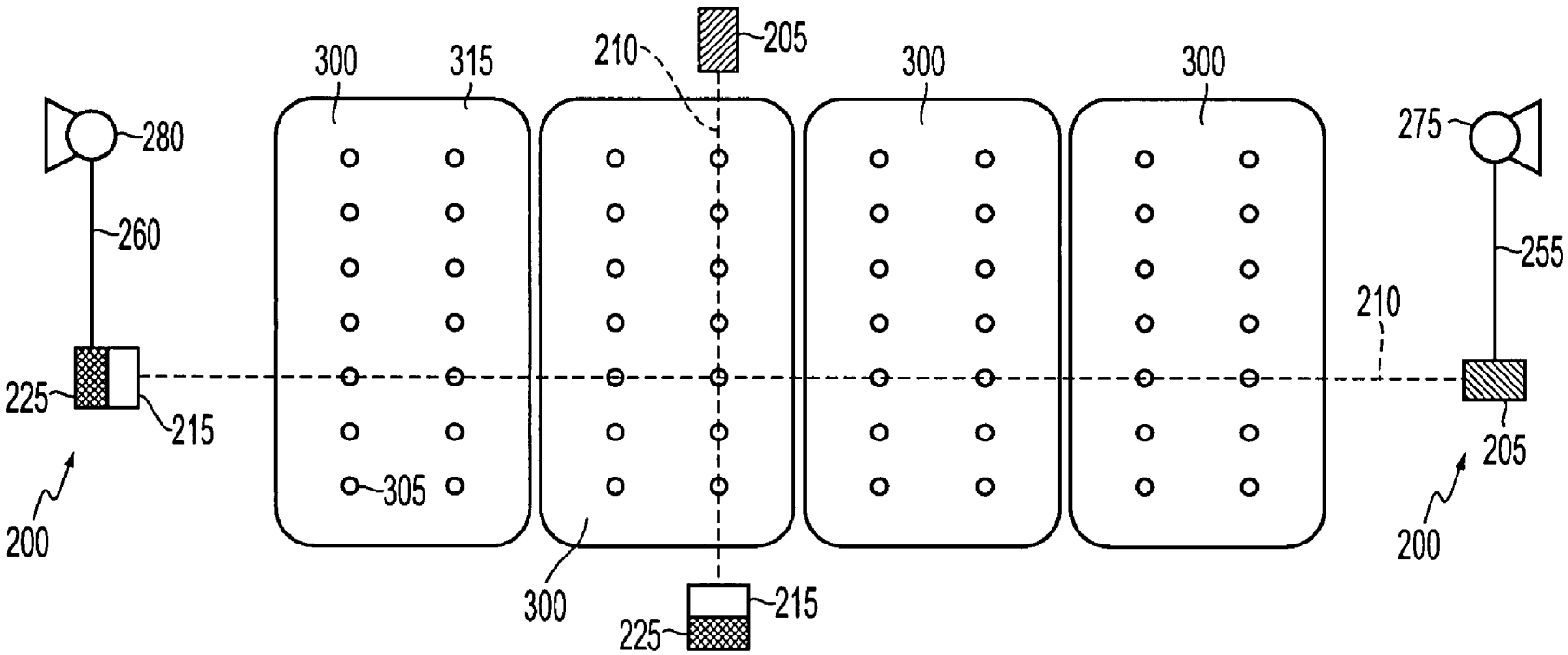
FIG. 3 is a view of a fluid ejector device from a first direction.

For simplicity and clarification, the operating principles and design factors of various exemplary embodiments of the systems and methods according to this invention are explained with reference to one exemplary embodiment of a carriage-type ink jet printer 100, as shown in FIG. 2, and one exemplary embodiment of a printhead 300 as shown in FIGS. 1–3. The basic explanation of the operation of the ink jet printer 100 and the printhead 300 is applicable for the understanding and design of any fluid ejection system that incorporates this invention. Although the systems and methods of this invention are described in conjunction with the ink jet printer 100 and the printhead 300, the systems and methods according to this invention can be used with any other known or later-developed fluid ejection system.

FIG. 2 shows a carriage-type thermal ink jet printing device 100. A linear array of droplet producing channels is housed in a printhead 300 mounted on a reciprocal carriage assembly 105. A number of ink droplets 310 are propelled towards a receiving medium 110, such as a sheet of paper, that is stepped by a motor 115 a preselected distance in a process direction, indicated by the arrow 120, each time the printhead 300 traverses across the receiving medium 110 along the scan axis perpendicular to the process direction. The receiving medium 110 can be stored on a supply roll 125 and stepped onto a take up roll 130 by the motor 115 or other means well known to those skilled in the art. For example, the receiving medium may be individual sheets of paper indexed in process direction 120.

In the exemplary embodiment shown in FIG. 2 droplets 310 are fired horizontally from the printhead 300 toward the receiving medium 110. However, the droplets 310 may also be propelled vertically or diagonally. Thus, although the systems and methods of this invention, as shown in exemplary embodiment FIG. 2, are described with reference to droplets 310 being fired horizontally, the systems and methods according to this invention can include droplets 310 being fired vertically or diagonally.

The printhead 300 is fixedly mounted on a support base 135 of the carriage assembly 105, which reciprocally moves along two parallel guide rails 145. The printhead 300 may be reciprocally moved by a cable or endless belt 150 and a pair of pulleys 155, one of which is powered by a reversible motor 160. The printhead 300 is generally moved across the receiving medium 110 perpendicular to the direction that the receiving medium 110 is moved by the motor 115. Of course, any other known or later-developed structure usable to move the carriage assembly 105 can be used in the ink jet printing device 100.

Alternatively, the linear array of droplet producing channels may extend across the entire width of the receiving medium 110, as is well known to those of skill in the art. This is typically referred to as a full-width array. See, for example, U.S. Pat. No. 5,160,403 to Fisher et al. and U.S. Pat. No. 4,463,359 to Ayata et al., each of which is incorporated herein by reference in its entirety.

An encoder 165 is located such that the location or position of the printhead 300 can be determined with respect to the carriage assembly and/or ink jet printing device 100. Exemplary encoders 165 may include a linear strip encoder or a rotary encoder. However, any known or later-developed structure usable to determine the position of the printhead 300 or fluid ejectors 305 can be used in the ink jet printing device 100.

In various exemplary embodiments, two drop detection modules 200 are located within the ink jet printing device 100, each preferably being provided to detect fluid droplets in a different plane. For example, in the embodiment illustrated, one is vertically aligned and one is horizontally aligned. However, the present invention is not limited to this. Moreover, while two modules are shown, only one drop detection module 200 is necessary for some embodiments of the present invention. The drop detection module 200 includes a laser 205, microscope 215, aperture 220, photodiode 225, and amplifier 230. As shown in FIG. 2, it is preferable that at least one drop detection module 200 is capable of movement in at least one plane.

In the exemplary embodiment, movable drop detection modules 200 may have the laser 205 mounted on a reciprocal carriage assembly 235 and the photodiode 225 and amplifier 230 mounted on a reciprocal carriage assembly 240. The reciprocal carriages 235, 240 may move along two parallel guide rails 245, 250, respectively. The reciprocal carriages 235, 240 may be moved by a cable 255, 260, respectively; and a pair of pulleys 265, 270, respectively. The reciprocal carriages may be powered by a reversible motor 275, 280, respectively. It is preferable that the movable drop detection module 200 is moved across the printhead 300 in a direction parallel to the direction that the receiving medium 110 is moved by motor 115. However, in some embodiments, one or more drop detection modules may be moved in a different direction, such as a direction perpendicular to the direction that the receiving medium 110 is moved by motor 115. Furthermore, in some embodiments, the drop detection module's laser may be capable of rotation and the photodiode capable of movement. With respect to the drop detection module's movement, and the rotation of the laser and the movement of the photodiode, any known or later-developed structure usable to move the drop detection module 200, or similarly, rotate the laser and move the photodiode may be used in the ink jet printing device 100.

In the exemplary embodiment, a second drop detection module 200 includes a laser 205 fixedly mounted on the ink jet printer 100, and a corresponding photodiode 225 and amplifier 230 also fixedly mounted on the ink jet printing device 100. In the exemplary embodiment shown in FIG. 2, this second drop detection module 200 is placed outside the paper path along the side of the paper, where generally there is more space. However, the drop detection module 200 may also be placed off the face of paper, and directly between the face of the paper and the printhead.

Each drop detection module 200 is oriented in a plane such that laser beam may be fired by laser 205 across printhead 300 and received by a corresponding photodiode 225 and, thus provide an indication of whether droplets 310 are ejected from individual nozzles of the printhead 300.

FIG. 3 shows one exemplary embodiment of four printheads 300 each including an array of fluid ejectors 305. A plurality of such ejectors 305 are found in a typical ink jet printhead 300. The systems, methods and architectures according to this invention may be used with side-shooter type ejectors, roof-shooter type ejectors, or other ejectors.

FIG. 3 is a view from a first direction showing a front face 315 of four exemplary printheads 300. In this exemplary embodiment, each printhead 300 is shown for illustrative purposes with seven rows of ejectors 305 and two columns of ejectors 305 on the face 315. In an exemplary embodiment, the ejectors 305 are sized and arranged in linear arrays of 300 to 1200 or more of the ejectors per inch. Other arrangements and dimensions can be used in other exemplary embodiments, as known to those skilled in the art. Of course, fluid ejectors need not be structured on the printhead in rows or columns or include multiple ejectors.

The face of the printhead may include a single printhead color, or may contain multiple color nozzles, such as a four color printhead (CMYK), including a cyan ink ejector group, a magenta ink ejector group, a yellow ink ejector group, and a black ink ejector group.

The printheads 300 may be capable of movement in the scanning direction. The scanning direction is perpendicular to the process direction. Similarly, at least one drop detection module 200 may be capable of movement in a direction other than the scanning direction. Furthermore, as in the exemplary embodiment shown, at least one other drop detection module 200 may be fixedly attached to the ink jet printing device 100. In the illustrative embodiment, one drop detection module is oriented horizontally while a second drop detection module is oriented vertically.

Figure 4:
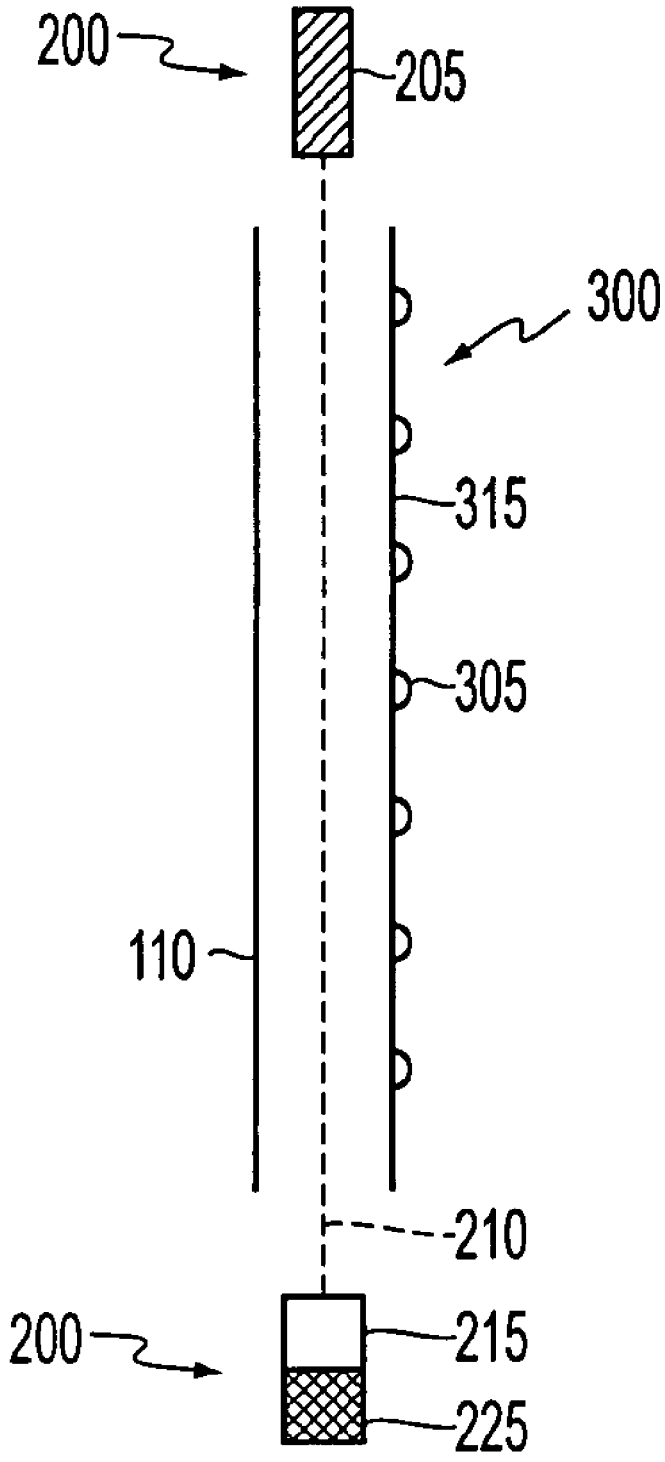
FIG. 4 is a view of a fluid ejector device from a second direction.

FIG. 4 is a view of a fluid ejector device from a second direction, perpendicular to the view of FIG. 3. In use fluid, such as a drop (not shown), is emitted from ejectors 305. The fluid travels generally perpendicular to beam 210 toward recording medium 110. The individual droplets are then sensed by the drop detection module 200.

Figure 5:
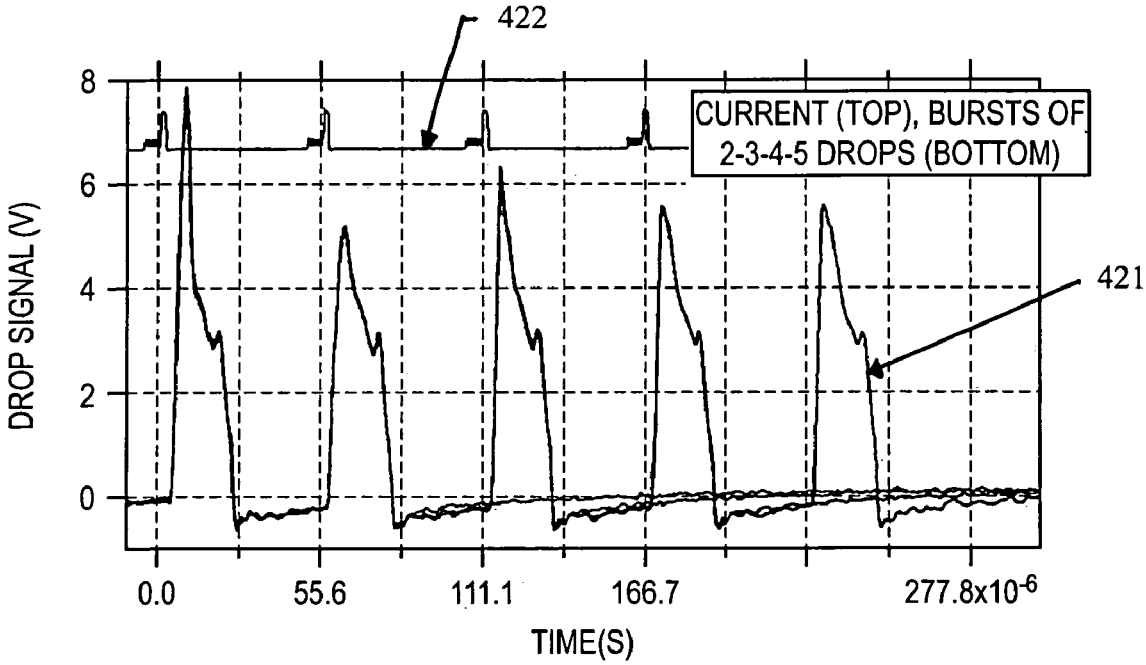
FIG. 5 is a graph showing an output drop signal from a photodiode over time.

FIG. 5 is a graph showing two plots. Plot 421 is a plot showing an output drop signal from a photodiode 225 over time using the printhead 300 and drop detection modules 200 of FIGS. 2–4. Plot 422 is a plot of the current sent to a heater of a fluid ejector 305, in order for a fluid ejector 305 to fire a drop.

In general, the graph shown in FIG. 5 may be generated as follows. A controller signals a fluid ejector 305 on a printhead 300 to fire at least one drop 310 such as by sending a current burst or pulse 422 to the heater of a fluid ejector 305. If the drop 310, fired by the fluid ejector, impinges laser beam 210, fired by drop detection module 200, a shadow is created. The shadow signifies the failure of the photodiode 225 to receive the laser beam 210. The shadow is focused by the microscope 215 through the aperture 220 onto the photodiode 225. The microscope 215 is not essential to the present invention, however it may increase the spatial resolution of the drop detection module 200. The shadow or lack of shadow signal 421 once received by the photodiode 225 may be amplified by an amplifier 230 and transmitted to the computer 400. The amplifier is not essential to the present invention, however it strengthens the signal 421 transmitted to the computer 400.

The signal 421, from the photodiode 225, is plotted on the graph shown in FIG. 5. The spikes in the plot 421 coincide with individual drops 310 that impinged the laser beam 210. Coincidentally, the spikes in plot 422 coincide with where a current burst was sent to a fluid ejector as the signal to fire a drop. Thus, by monitoring the drop signal 421 and selectively ejecting fluid from each of the ejectors 305, it is possible to detect the firing of very small quantities of liquid from individual ejectors. In fact, by use of the laser/photodiode arrangement, determination of droplets as small as 1 picoliter can be detected and resolved.

In the exemplary embodiment shown in FIG. 5, the drop signal (y value) ranges in voltage (V) from 0 to 8 and the time signal (x-value) ranges in seconds (s) from 0 to $277.8\times10^{-6}$. However, other values and ranges for current and time may also be used in the systems and methods according to this invention.

Figure 6:
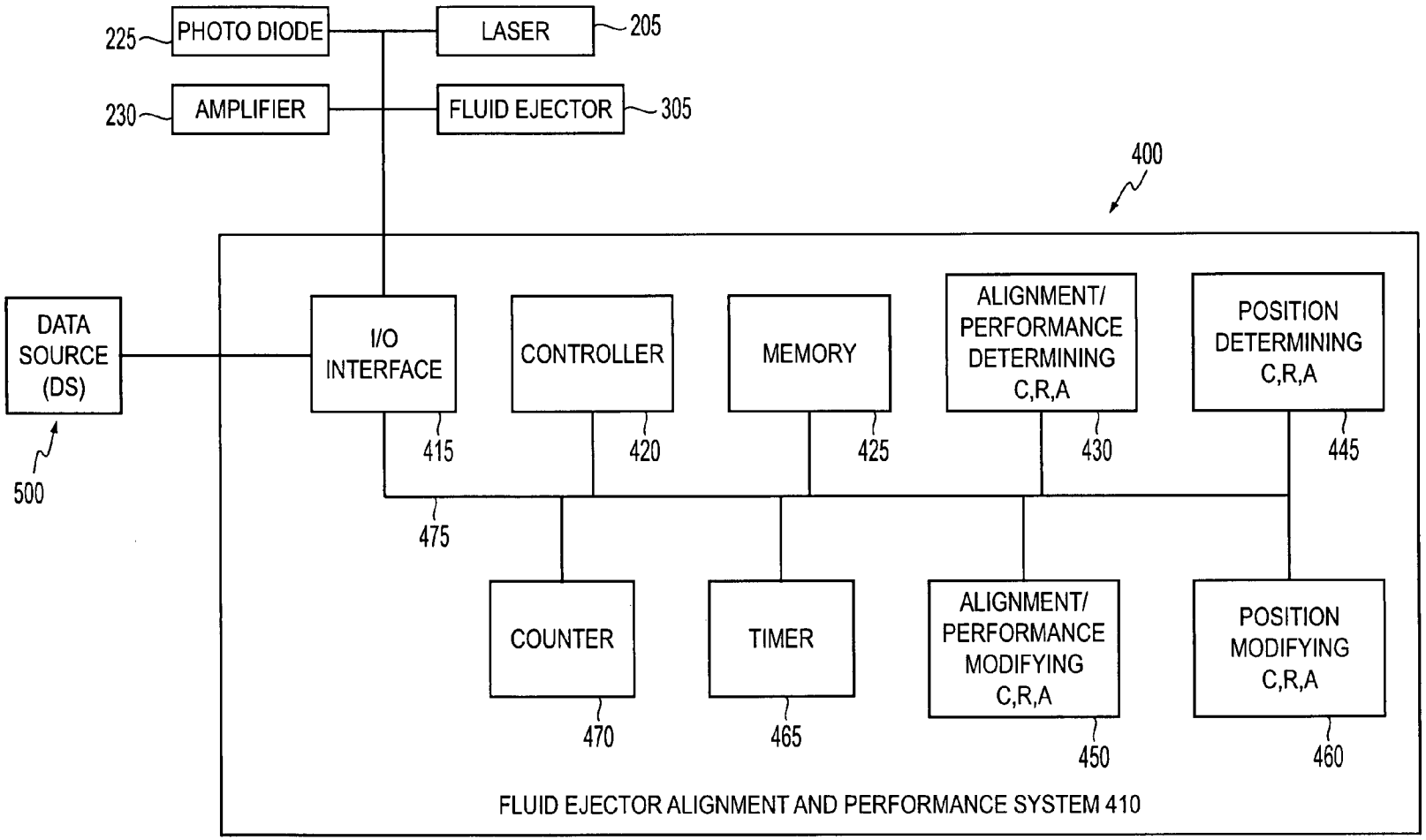
FIG. 6 is a block diagram of an exemplary fluid ejector alignment and performance system according to the invention.

FIG. 6 shows one exemplary embodiment of a fluid ejector alignment and performance system 410 that controls fluid ejector alignment and performance according to this invention. This system may be housed in computer 400. As shown in FIG. 6, the fluid ejector alignment and performance system 410 includes an input/output interface 415, a controller 420, a memory 425, an alignment and performance determining circuit, routine or application 430, a position determining circuit, routine or application 445, an alignment and performance modifying circuit, routine or application 450, a position modifying circuit, routine or application 460, a timer 465, and a counter 470 interconnected by one or more control and/or data busses and/or application programming interfaces 475. I/0 interface 415 may receive data signals, such as an image signal as an input for ejector firing, from a datasource (DS) 500.

As shown in FIG. 6, the fluid ejector alignment and performance system 410 is, in various exemplary embodiments, implemented on a programmed general purpose computer. However, the fluid ejector alignment and performance system can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowchart shown in FIGS. 7–15, can be used to implement the fluid ejector alignment and performance system.

In FIG. 6, alterable portions of the memory 425 are, in various exemplary embodiments, implemented using static or dynamic RAM. However, the memory 425 can also be implemented using a floppy disk and disk drive, a writable optical disk and disk drive, a hard drive, flash memory or the like. In FIG. 6, the generally static portions of the memory 425 are, in various exemplary embodiments, implemented using ROM. However, the static portions can also be implemented using other non-volatile memory, such as PROM, EPROM, EEPROM, an optical ROM disk, such as a CD-ROM or DVD ROM, and disk drive, flash memory or other alterable memory, as indicated above, or the like.

As shown in FIG. 6, the memory 425 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewritable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

It should be understood that each of the various embodiments of the fluid ejector alignment and performance system 410 can be implemented as software executing on a programmed general purpose computer, a special purpose computer, a microprocessor or the like. It should also be understood that each of the circuits, routines, applications, objects or managers shown in FIG. 6 can be implemented as portions of a suitably programmed general-purpose computer. Alternatively, each of the circuits, routines, applications, objects or managers shown in FIG. 6 can be implemented as physically distinct hardware circuits within an ASIC, using a digital signal processor (DSP), using a FPGA, a PLD, a PLA and/or a PAL, or using discrete logic elements or discrete circuit elements. The particular form of the circuits, routines, applications, objects or managers shown in FIG. 6 will take is a design choice and will be obvious and predictable to those skilled in the art. It should be appreciated that the circuits, routines, applications, objects or managers shown in FIG. 6 do not need to be of the same design.

Further, it should be appreciated that the programming interfaces 475 connecting the memory 425 to the computer 400 can be a wired or wireless link to a network. The network can be a local area network, a wide area network, an intranet, the Internet, or any other distributed processing and storage network.

The fluid ejector alignment and performance system may not only be run to check alignment and/or performance manually, it may also be run automatically. If the system is manually operated, the user inputs a request to start the system. If the system is set to automatically run, the system is set to run by the controller 420. If the fluid ejector alignment and performance system is automatically run, various exemplary embodiments of the present invention may allow the system to be run based on either a print count counter 470 or a timer 465. For example, it could be run at start up, after a predetermined number of print jobs, or after replacement of any of the printheads. Of course, any other know or later developed method to automatically run the fluid ejector alignment and performance system may be employed in the present invention.

If the fluid ejector alignment and performance system is automatically run, the controller 420 selects the at least one fluid ejector to be tested and, if necessary, modified. Alternatively, a routine may be implemented to select multiple fluid ejectors. For example, a routine may be selected to select multiple fluid ejectors, such that the drop detection module may ripple through each fluid ejector in a column or row of the printhead, until all ejectors have been fired and tested.

A particular fluid ejector or group of fluid ejectors may be automatically selected based on the results determined by the use of a drop detection module to determine a fluid ejector's operating properties in a different plane. Other automatic methods for selecting fluid ejectors may include a routine that selects an arbitrary fluid ejector based on the image or type of image to be printed, fluid ejectors selected based on a timer 465, or fluid ejectors selected based on a print count counter 470. Of course, any other known or later developed method of selecting a fluid ejector may be employed in this invention.

If timer 465 is used to control the running of the fluid ejector alignment and performance system, controller 420 automatically selects fluid ejectors for alignment and performance testing and, if necessary, modification, based on an internal clock.

Similarly, if a print count counter 470 is used to control the running of the fluid ejector alignment and performance system, controller 420 may automatically select fluid ejectors for alignment and performance testing and, if necessary, modification, based on a print count of the selected fluid ejector.

Once the group or set of fluid ejectors to be tested has been selected, a first fluid ejector of the set is selected for determining alignment and/or performance operating properties and, if necessary, modification.

The alignment and/or performance determining control, routine, or application 430 employs at least one drop detection module to determine an operating alignment and/or performance property of a selected fluid ejector.

The alignment and/or performance modifying control, routine, or application 450 may employ various methods, to make compensation determinations. These compensation determinations may then be applied to a fluid ejector or otherwise used to modify the alignment or performance properties of a selected fluid ejector.

Figure 7:
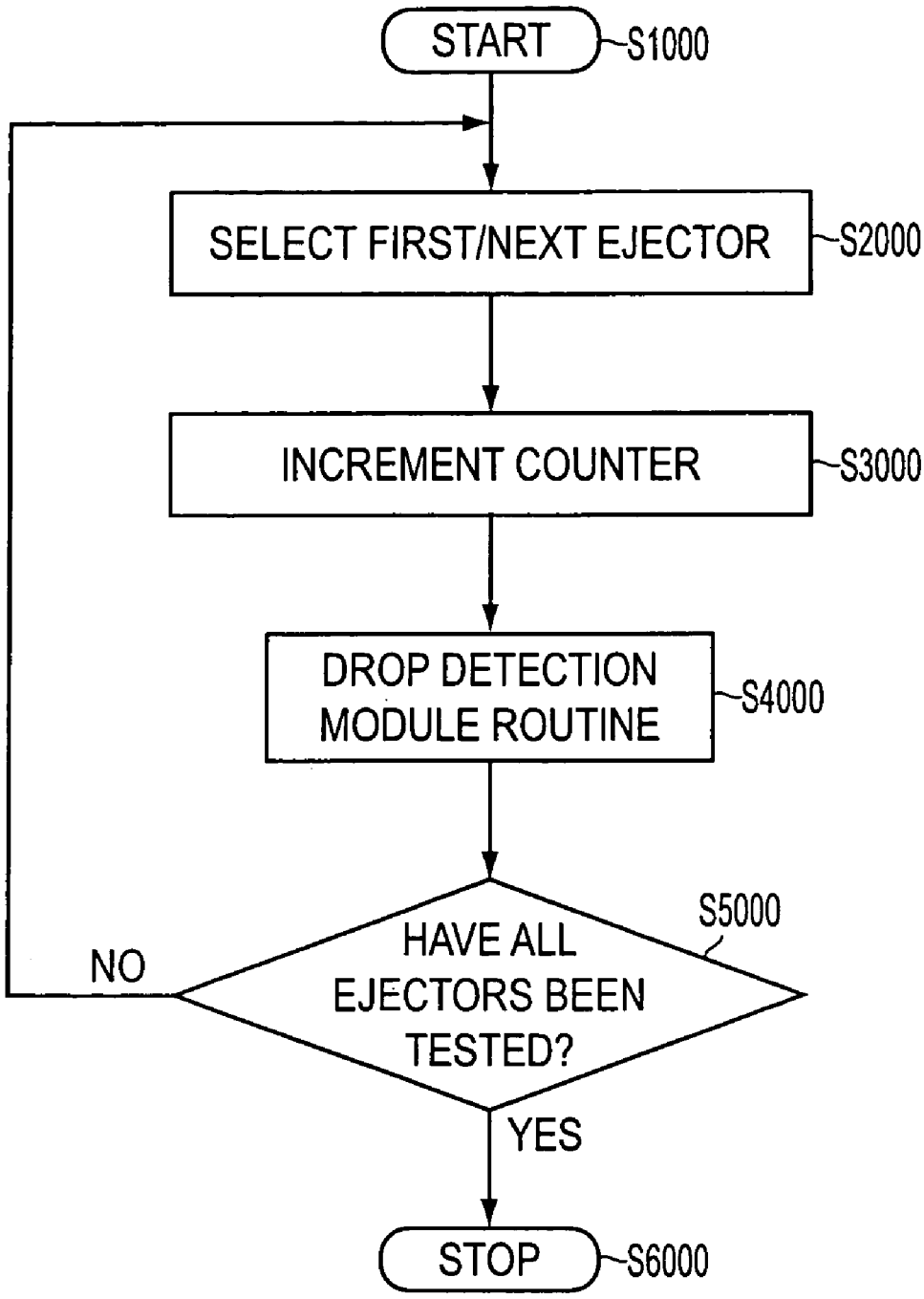
FIG. 7 is a flowchart outlining one exemplary embodiment of a method for automatically determining fluid ejector alignment and performance according to the invention.

FIG. 7 is a flowchart outlining one exemplary embodiment of a method for automatically determining fluid ejector alignment and performance. In step S1000, the routine begins. The routine continues to step S6000.

In step S2000, a fluid ejector or set of fluid ejectors is selected to be tested for either or both alignment and performance. This fluid ejector's alignment and/or performance may also be modified in this routine.

After at least one fluid ejector has been selected, the control routine continues to step S3000.

In step S3000, the control routine applies an increment counter to count which fluid ejectors of a selected set have been tested.

In step S4000, the drop detection module control routine is run. In this step, a method for using at least one drop detection module to determine fluid ejector alignment and performance is applied to the selected fluid ejector. Furthermore, in this step, the fluid ejector alignment and performance may be modified by applying an alignment and/or performance determining and modifying control, routine, or application to the selected fluid ejector. Various exemplary modes for using the drop detection module for determining fluid ejector alignment and performance are possible and several exemplary modes will be described later in the specification in more detail.

After step S4000 has been applied to a selected fluid ejector, the control routine continues to step S5000. In step S5000, a determination as to whether all of the selected fluid ejectors have been tested is made. If the determination in step S5000 is that all selected fluid ejectors have been tested, the routine continues to step S6000 where the routine ends. If the determination in step S5000 is that not all of the selected fluid ejectors have been tested, the routine returns to step S2000 where a next fluid ejector is selected. Accordingly, the routine continues from step S2000 through step S5000 until all fluid ejectors have been tested.

Figure 8:
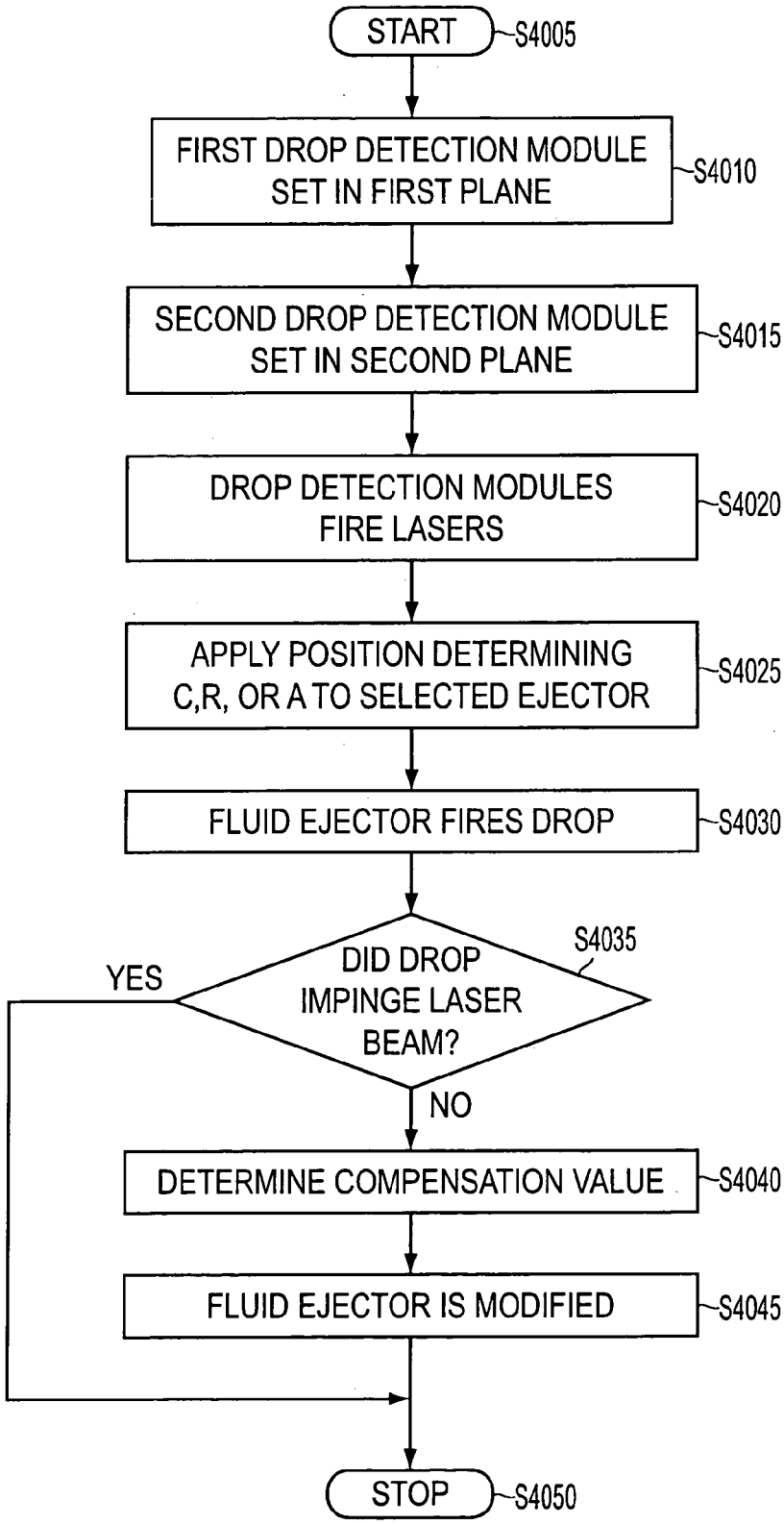
FIG. 8 is a flowchart outlining one exemplary embodiment of a method for using the drop detection module to determine and, if necessary, modify fluid ejector alignment and performance according to the invention.

FIG. 8 is a flowchart outlining one exemplary embodiment of a method for using the drop detection module to determine and, if necessary, modify fluid ejector alignment and performance. In step S4005, the routine begins.

In step S4010, a first drop detection module is set in a first plane. In step S4015, a second drop detection module is set in a second plane, wherein the second plane is different from the first plane.

In various exemplary embodiments, the drop detection module may be set in planes different than the planes described in the specification or shown in the drawings. The plane within which the drop detection module is positioned determines the fluid ejector alignment the module may test for. For example, for fluid ejector alignment in one plane, such as vertical or horizontal alignment with respect to the scanning direction (face of the printhead), a drop detection module may be positioned in a plane parallel or perpendicular to the scanning direction, respectively.

After the drop detection modules are set, the routine continues to step S4020 where the lasers on the drop detection modules are fired. The lasers need not be fired simultaneously. The lasers are fired with respect to the plane in which fluid ejector alignment or performance information is desired to be obtained. In various exemplary embodiments, a light emitter, such as an LED, may be substituted for a laser.

In step S4025, a position determining control, routine, or application is applied to the selected fluid ejector to determine the fluid ejector's position relative to a fiducia on the ink jet printing device.

The fluid ejector offset can also be determined from the position determining control, routine, or application. The position determining control, routine, or application may use the drop detection module to determine the position of a fluid ejector based on when a drop fired by a fluid ejector impinges the laser beam.

In step S4030, the selected fluid ejector fires a drop.

After the drop has been fired, the routine continues to step S4035 where a determination is made whether the drop impinged the laser beam of one or more of the respective drop detection modules operating in the routine. If the drop impinged the laser beam, the routine continues to step S4050 where the routine ends. However, if a determination is made that the drop did not appear to impinge at least one laser beam, the routine continues to step S4040.

In step S4040, the compensation determination is calculated automatically by the alignment and/or performance modifying control, routine, or application. A compensation determination is calculated for the fluid ejector nozzles that fail to have at least one drop impinge the laser beam. This compensation can be performed after individual nozzle firing, or after completion of an array of nozzle firings.

After the compensation determination, the routine continues to step S4045. In step S4045, the selected fluid ejector is modified in accordance with the compensation determination made by the alignment and/or performance modifying control, routine, or application. The compensation determination can then be applied by the alignment and/or performance modifying control, routine, or application to modify the fluid ejector alignment and/or performance electronically. Where a fluid ejector cannot be adequately modified electronically, a different compensation determination, such as compensation value, may be calculated and applied to the image data. This value is applied to the image data to modify the image data such that the printed product does not reflect the apparent fluid ejector alignment or performance error. Other methods for modifying fluid ejector alignment and performance will be discussed further in the specification.

After step S4045, the control routine continues to step S4050 where the control routine ends. In various exemplary embodiments, step S4050 may also contain a further routine where steps, including steps S4010 through step S4050, are re-applied to the selected fluid ejector to determine whether the alignment and/or performance control, routine, or application has sufficiently modified the selected fluid ejector.

As discussed above, the plane within which the drop detection module is positioned determines the fluid ejector alignment the module may test for. For example, FIG. 9 and FIG. 10 show two exemplary embodiments of a method to determine horizontal alignment and vertical alignment, respectively.

Figure 9:
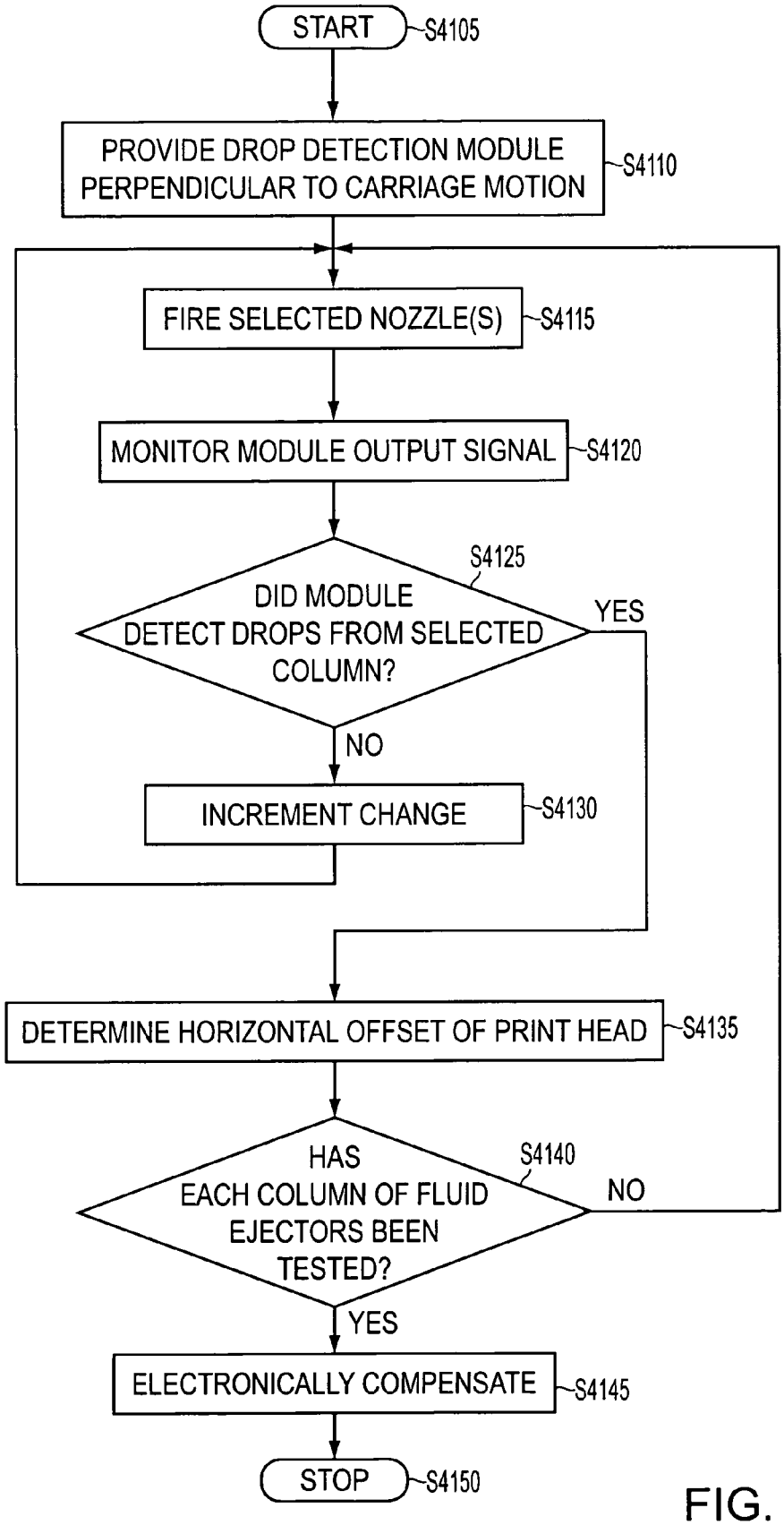
FIG. 9 is a flowchart outlining one exemplary embodiment of a method for using the drop detection module to determine and, if necessary, electronically compensate, horizontal printhead alignment according to the invention.
Figure 10:
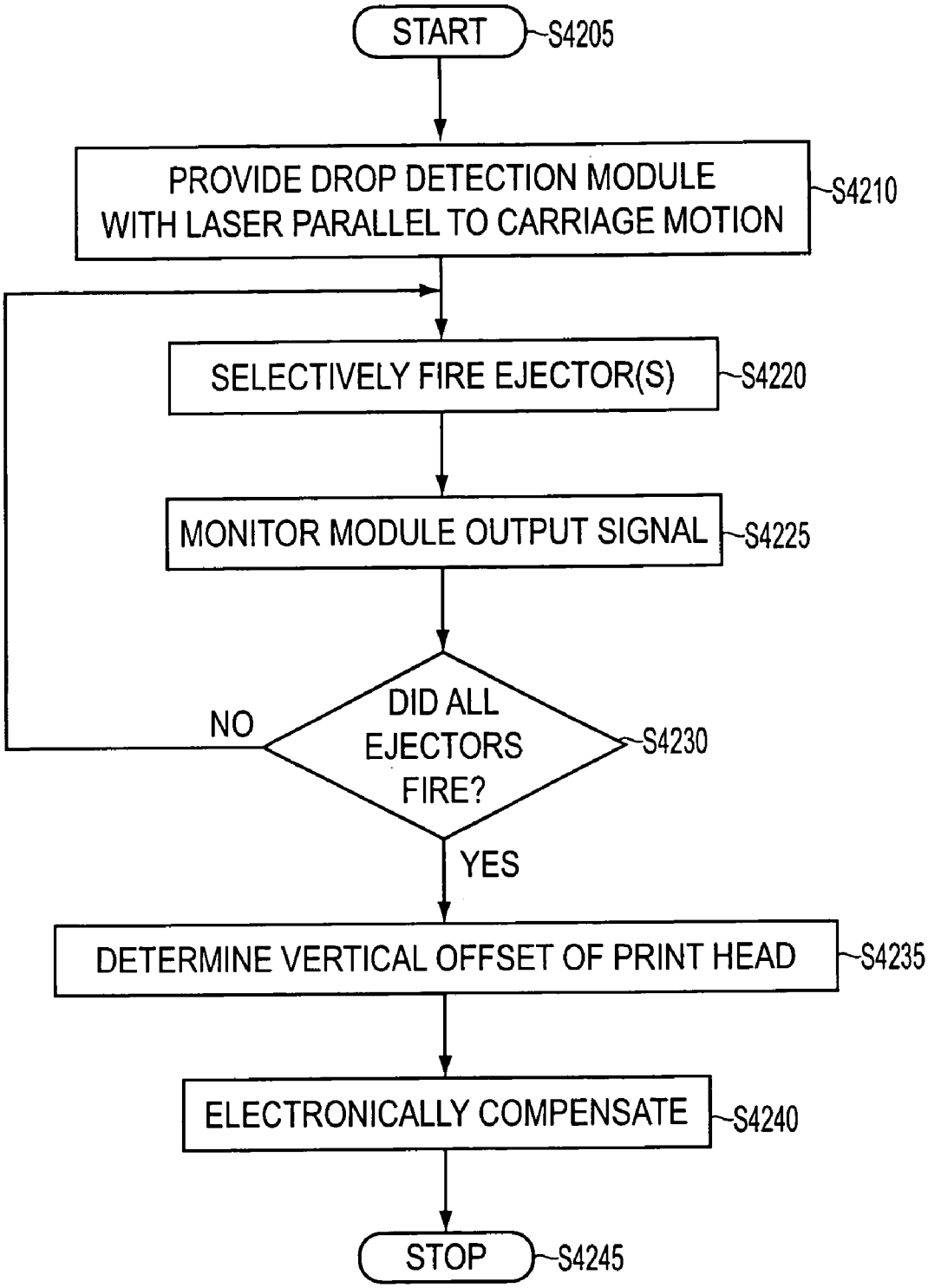
FIG. 10 is a flowchart outlining one exemplary embodiment of a method for using the drop detection module to determine and, if necessary, electronically compensate, vertical printhead alignment according to the invention.

FIG. 9 is a flowchart outlining one exemplary embodiment of a method for using the drop detection module to determine, and if necessary, modify fluid ejector horizontal head alignment and performance. In step S4105, the routine begins.

In step S4110, a drop detection module is set in a plane perpendicular to the carriage motion.

In step S4115, one or more selected fluid ejectors fire a drop from the printhead. This may, for example, be a middle ejector in the array. After the drop has been fired, the control routine continues to step S4120 where the signal generated by the photodiode is monitored. After step S4120 the control routine continues to step S4125.

In step S4125, a determination is made as to whether the column of ejectors selected has been detected. If the determination is that the column of selected fluid ejectors has not been detected, the control routine proceeds to step S4130. In step S4130, the printhead carriage incrementally moves across the laser beam and steps S4115, S4120, and S4125 are repeated until the column of selected fluid ejectors is detected. Alternatively, drop module 200 may be incremented while the printhead remains fixed.

If a determination is made that the column of selected fluid ejectors has been detected, the control routine continues to step S4135 where the horizontal offset of this printhead and/or column of ejectors is determined from the position of the carriage when a drop impinged the laser beam. The horizontal offset of each printhead and/or column of ejectors may be a relative or absolute offset amount. It may be based on the determination of the position of the carriage relative to drop module when the fluid ejector drops impinge the laser beam and/or based on known distances between nozzles. After step S4135 has been completed, the control routine continues to step S4140.

In step S4140, a determination is made as to whether each column of ejectors has completed steps S4115 through S4135. If the determination is that a column has not completed steps S4115 through S4135 the control routine returns to S4115 where the next column completes the steps S4115 through S4135. Otherwise, the control routine continues to step S4145.

In step S4145, error due to the horizontal offset of each printhead nozzle can be compensated for electronically by known or subsequently developed methods, such as delayed firing, print mask compensation, etc.

After step S4145, the control routine continues to step S4150 where the control routine ends. In various exemplary embodiments, step S4150 may also contain a further routine where steps, including step S4110 through step S4145, are re-applied to the selected fluid ejector to determine whether the alignment and/or performance control, routine, or application has sufficiently modified the selected fluid ejector.

Similarly, FIG. 10 is a flowchart outlining one exemplary embodiment of a method for using a drop detection module to determine and, if necessary, modify fluid ejector vertical head alignment and performance. In step S4205, the routine begins.

In step S4210, a drop detection module is set in a plane such that the laser beam is parallel to the carriage motion.

After the drop detection module is set, the routine continues to step S4220 where the control routine selectively fires one, some, or all of the fluid ejectors. After step S4220, the control routine continues to step S4225.

In step S4225, the control routine monitors the drop output signal generated by the photodiode. This step includes the photodiode alerting the controller when a drop either impinges or fails to impinge the laser beam. After step S4225 has been completed, the control routine continues to step S4230.

In step S4230, a determination is made of whether at least one ejector from each column and/or printhead has been detected. If ejectors from all columns and/or printheads have not been detected, the control routine returns to step S4220, where steps S4220 through step S4230 are re-applied after selecting different ejectors and/or moving the drop detection module with respect to the printhead. If a determination is made that ejectors from all columns and/or printheads have been detected, the control routine continues to step S4235 where the vertical offset of each column and/or printhead is determined by analysis of which of the fluid ejector's drops impinged the laser.

After step S4235 is completed, the control routine continues to step S4240. In step S4240 the vertical offset of each printhead can be compensated for electronically.

After step S4240, the control routine continues to step S4245 where the control routine ends. In various exemplary embodiments, step S4245 may also contain a further routine where steps, including steps S4210 through step S4240, are re-applied to the selected fluid ejector to determine whether the alignment and/or performance control, routine, or application has sufficiently modified the selected fluid ejector.

Besides fluid ejector alignment in the vertical or horizontal direction with respect to the face of the printhead, fluid ejector tilt alignment and bi-directional alignment may also be determined and modified, if necessary, by using at least one drop detection module with the alignment determining and modifying control, routine, or application.

To determine tilt alignment, at least two fluid ejectors are tested and the drop detection module is positioned such that the position of at least two fluid ejectors can be determined. It is preferred that the fluid ejectors selected be at opposite ends of the printhead. Each fluid ejector separately fires a drop and the drop detection module separately records the signal generated by each respective drop. Once the drop detection module has sent each respective signal to the computer, the fluid ejector offset for each fluid ejector can be determined from the position determining control, routine, or application.

Next, a compensation determination can be generated by the alignment and/or performance routine or application. A compensation value to be applied to the image data can be generated and applied to modify the image data prior to printing. Thus, once the image data is printed, the apparent error due the printhead tilt offset is reduced because of the compensation value applied to modify the image data. Generally, compensation values can be generated to modify printhead tilt offsets of greater than one pixel.

Figure 11:
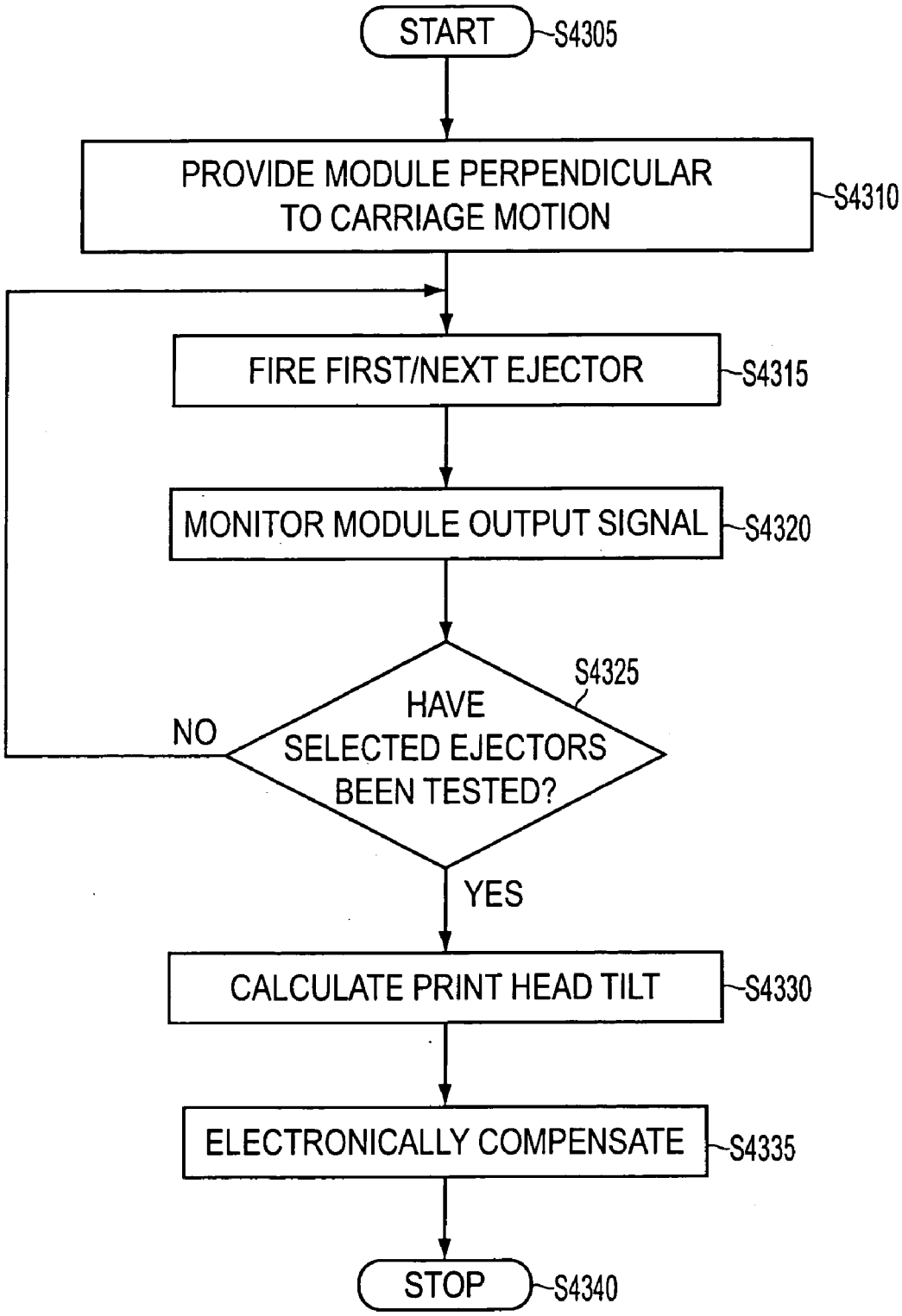
FIG. 11 is a flowchart outlining one exemplary embodiment of a method for using the drop detection module to determine and, if necessary, electronically compensate, printhead tilt according to the invention.

FIG. 11 is a flowchart outlining one exemplary embodiment of a method for using the drop detection module to determine and, if necessary, modify fluid ejector tilt alignment and performance. In step S4305, the routine begins.

In step S4310, drop detection module is provided such that the laser beam fired from the drop detection module is in a plane perpendicular to the carriage motion.

After the drop detection module is set, the routine continues to step S4315 where a first selected fluid ejector fires a drop. After step S4315, the control routine continues to step S4320.

In step S4320 the output signal generated by the photodiode is monitored to determine whether the drop fired impinged the laser beam. After step S4320, the control routine continues to step S4325.

In step S4325, a determination is made of whether at least two fluid ejectors have been tested. If the selected number of fluid ejectors has not been tested, the control routine returns to step S4315 where the next fluid ejector is fired. Preferably, the selected ejectors span the entire column of drop ejectors being aligned for improved accuracy. As such, steps S4315 through step S4325 are applied to the next fluid ejector. If instead, in step S4325 a determination is made that the selected number of ejectors has been tested, the control routine continues to step S4330 where the printhead tilt is determined.

Once the printhead tilt has been determined, the control routine continues to step S4335 where a compensation value can be determined and applied to the image data to compensate for printhead tilt.

After step S4335, the control routine continues to step S4340 where the control routine ends. In various exemplary embodiments, step S4340 may also contain a further routine where steps, including steps S4310 through step S4335, are re-applied to the printhead to determine whether the alignment and/or performance control, routine, or application has sufficiently modified the image data appropriately.

Figure 12:
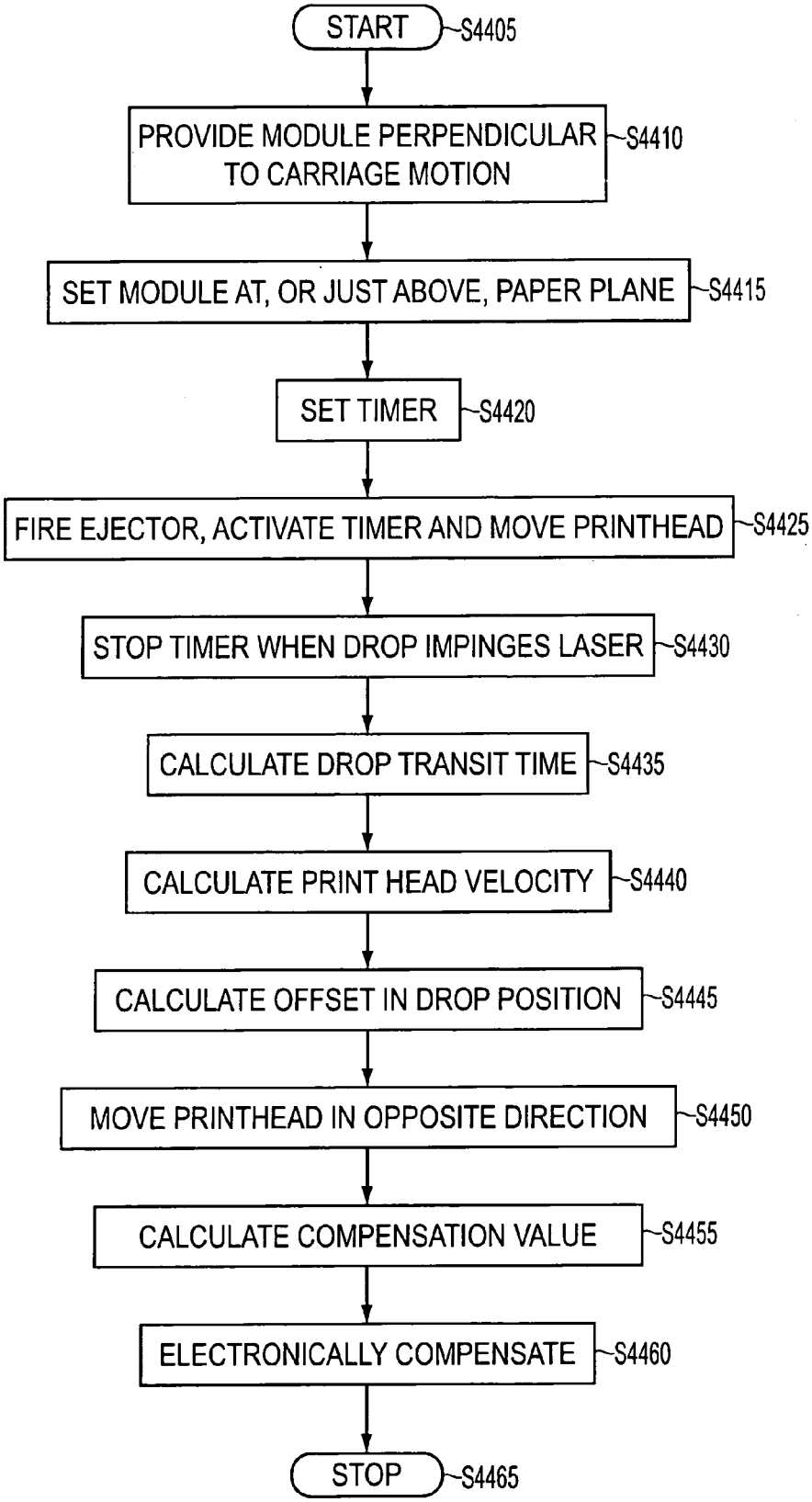
FIG. 12 is a flowchart outlining one exemplary embodiment of a method for using the drop detection module to determine and, if necessary, electronically compensate, bi-directional alignment according to the invention.

Fluid ejector bi-directional alignment may also be determined and modified in a similar manner. FIG. 12 is a flowchart outlining one exemplary embodiment of a method for using a drop detection module to determine and, if necessary modify fluid ejector alignment and performance. In step S4405, the control routine begins.

In the exemplary embodiment shown in FIG. 12, in step S4410 a drop detection module is provided perpendicular to carriage motion. Next, in step S4415, the drop detection module is set at, or close to the paper plane. The drop detection module does not have to be above the paper itself, but may be placed outside the paper path. The drop detection module should be located such that the laser beam is perpendicular to the carriage motion. The drop detection module should also be positioned with respect to a fiducia, such that the drop detection module position is known relative to both the paper and printhead.

After step S4415 has been completed, the control routine continues to step S4420 where a timer is set. After the timer has been set, the control routines continues to step S4425. In step S4425, the laser on the drop detection module is fired. The printhead is then moved in the scanning direction and the fluid ejector's position is determined relative to a fiducia on the ink jet printing device. While the printhead is moving, a selected fluid ejector fires a drop and, simultaneously, a timer controlled by a controller is activated.

After the fluid ejector fires a drop and the timer is activated, in step S4430 the timer is stopped when the drop impinges the laser beam.

Once the drop has impinged the laser beam, the routine continues to step S4435 where the drop transit time from drop ejection until when the drop impinged the laser beam is calculated.

After step S4435 has been completed, the control routine continues to step S4440 where the fluid ejector velocity due to printhead movement in the scanning direction, while the drop was in transit between the nozzle and impingement of the laser beam, is calculated. This information may be calculated using signals from position encoder.

Next, in step S4445, the drop offset from the position the drop was projected to impact the paper is determined based on the transit time and printhead velocity. After the offset and drop position have been calculated, the control routine continues to step S4450.

In step S4450, steps S4420 to S4445 are repeated with the printhead moved in the direction opposite to the direction the printhead was initially moved. The printhead was initially moved in step S4425.

In step S4455, a compensation value can be determined to control the firing times of the fluid ejectors, or the image data can be modified so that errors in image quality, due to bi-directional alignment error, can be reduced or, at least, be visually less apparent.

Next, as shown in step S4455, the compensation value can be applied to the image data to electronically compensate for bi-direction alignment error.

After step S4455, the control routine continues to step S4460 where the control routine ends.

When determining and modifying bi-directional alignment, it is important that the drop detection module be adequately located with respect to the printhead and paper. If positioning of the drop detection module is difficult, such that the transit time of the drop to he paper cannot be directly measured, then an additional step may be added to the bi-directional alignment routine.

In this step, the transit time of drops from the same fluid ejector is determined at two different distances from the printhead. This requires that the drop detection module or portions thereof be moved a known distance between printhead and paper. The drop detection module or portions thereof can be moved with a motor. The approximate drop speed can be determined from the change in transit time and the change in distance. Then, knowing the nominal distance between printhead and paper allows the approximate determination of the transit time of the drop to the paper.

As discussed above, the alignment and performance modifying control, routine, or application calculates the preferred method of using the selected fluid ejectors to create the printed image. For example, among other compensation determinations, the routine may result in the calculation of a compensation value by which to rotate or stretch an image, or result in a decision to wipe or prime a selected fluid ejector, change the voltage to a selected fluid ejector, or skip a fluid ejector during the printing process. Automatic modification of a fluid ejector for either alignment and/or performance may also include any other known or later developed method for modifying a fluid ejector.

Figure 13:
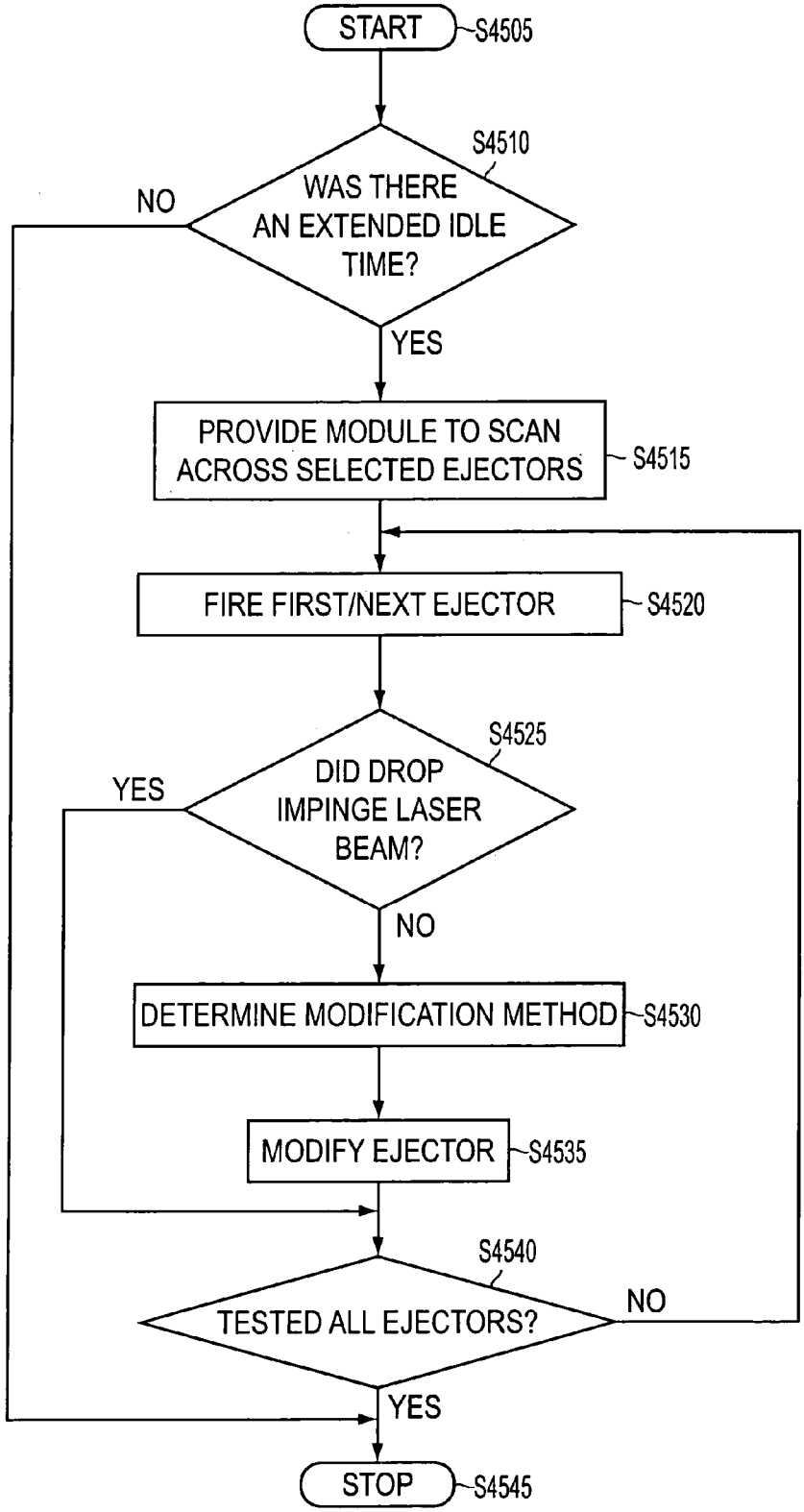
FIG. 13 is a flowchart outlining one exemplary embodiment of a method for using the drop detection module to determine and, if necessary, modify fluid ejector performance for ejector problems, such as blocked or non-firing jets according to the invention.

For instance, as shown in FIG. 13, various exemplary embodiments of the present invention may include the detection and modification of a fluid ejector whose performance has deteriorated due to extended idle times. In the exemplary embodiment shown in FIG. 13, the recovery modification procedure can be employed after a selected fluid ejector has been exposed to an extended idle time. The recovery modification procedure may include modification techniques for modifying a fluid ejector, such as firing fluid through the ejector into a waste container, priming the fluid ejector, wiping the fluid ejector, heating the fluid ejector, or other methods familiar to those skilled in the art. After the recovery modification procedure, the fluid ejector may again be tested for alignment and/or performance.

FIG. 13 is a flowchart outlining one exemplary embodiment of a method for using the drop detection module to modify a fluid ejector. In step S4505 the control routine begins.

In step S4510 a determination is made as to whether there was an extended idle time for a fluid ejector or printhead. If the determination is that there was, the control routine continues to S4515, otherwise the control routine continues to step S4545 where the control routine ends.

In step S4515, a drop detection module is set in a first plane such that the laser on the drop detection module may scan across selected fluid ejectors. After the drop detection module is set, the routine continues to step S4520 where the selected fluid ejector fires a drop.

In step S4525, a determination is made of whether the fluid ejector drop impinged the laser beam of the drop detection module. If the drop impinged the laser beam, the routine continues to step S4540. However, if a determination is made that the drop did not appear to impinge the laser beam, the routine continues to step S4530.

In step S4530, a determination is made of a modification method to be applied to the selected fluid ejector. As discussed above, the modification method may include wiping or priming the fluid ejector or any other modification method known to those skilled in the art.

After a modification method has been determined, the routine continues to step S4535 where the modification method is applied to the selected fluid ejector.

After step S4535, the routine continues to step S4540 where a determination is made as to whether all fluid ejectors have been tested. If so, the control routine continues to step S4545 where the routine ends. If a determination is made that not all fluid ejectors have been tested, the control routine returns to step S4520 and repeats steps S4520 through step S4540 until all fluid ejectors have been tested.

In various exemplary embodiments, step S4545 may also contain a further routine where steps, including steps S4510 through step S4540, are re-applied to the selected fluid ejector to determine whether the alignment and/or performance control, routine, or application has sufficiently modified the selected fluid ejector.

As discussed above, many modification procedures may be used with the present invention. For instance, modification procedures may be employed to correct kogation, refill problems and frequency problems. If the fluid ejector has kogation or threshold voltage variation problems, drop speed variations may be adjusted with different enable trains or main pulse length. After a modification procedure has adjusted an enable train or main pulse length, the fluid ejector can be re-tested and the enable train re-modified until the fluid ejector drop speed is within acceptable tolerances.

Other problems with fluid ejectors such as refill problems and maximum frequency problems may also be confronted by modification procedures. For instance, if a filter clogs causing firing before re-fill and/or exceedingly fast drops such as spears occur, the fluid ejector and printer can be modified for lower frequency jetting to modify the problem.

Figure 14:
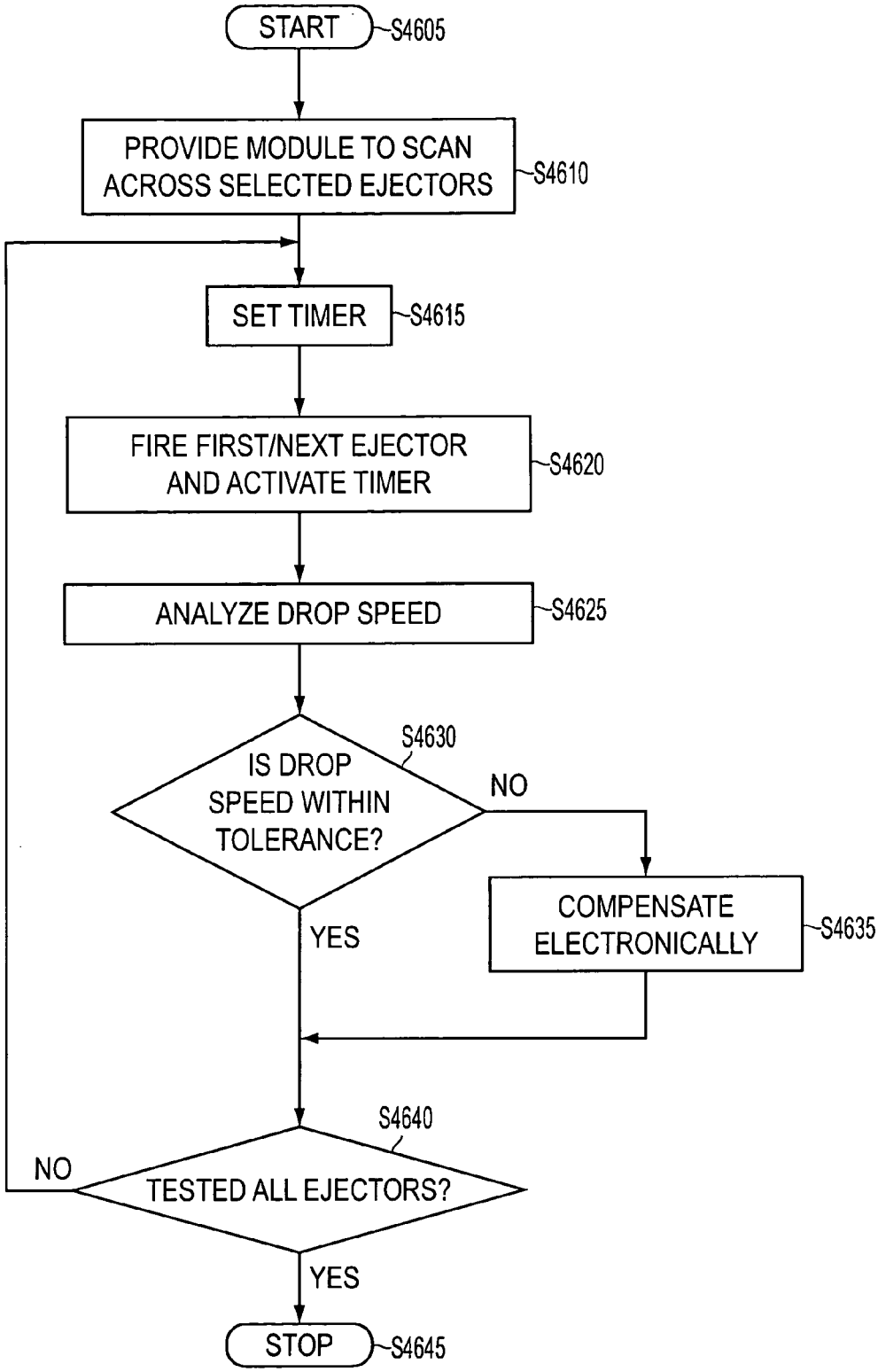
FIG. 14 is a flowchart outlining one exemplary embodiment of a method for using the drop detection module to determine and, if necessary, modify fluid ejector performance for ejector problems such as kogation, re-fill, and maximum frequency problems, according to the invention.

FIG. 14 is a flowchart outlining one exemplary embodiment of a method for using the drop detection module to determine and, if necessary, modify fluid ejector alignment and performance. In step S4605, the routine begins.

In step S4610, a drop detection module is set in a first plane to scan selected fluid ejectors.

After the drop detection module is set, the routine continues to a step S4615 where a timer is set. After the timer has been set, the control routine continues to step S4620 where a first fluid ejector fires a drop. Simultaneously, the timer is activated.

After the drop has been fired and the timer activated the routine continues to step S4625 where the drop speed is analyzed. The transit time of drops from the same fluid ejector is determined at two different distances from the printhead. This requires that the drop detection module or portions thereof be moved a known distance between the printhead and paper. The drop detection module or portions thereof can be moved with a motor or the like. The approximate drop speed can be determined from the change in transit time and the change in distance.

After step S4625 has been completed, the routine continues to step S4630 where a determination is made of whether the drop speed is within acceptable product tolerances. If the drop speed is determined to be outside specific product tolerances, the routine continues to step S4635 where an electronic compensation can be determined and applied to a selected fluid ejector to compensate for drop speed. This compensation may include adjusting with different enable trains or adjusting the frequency of jetting. Once an electronic compensation has been applied to a selected fluid ejector, the routine continues to a step S4640.

However, if it is determined in step S4630 that drop speed is within acceptable product tolerances, the routine continues from step S4630 to step S4640.

In step S4640 a determination is made as to whether all fluid ejectors have been tested. If so, the control routine continues to step S4645 where the control routine ends. If, on the other hand, a determination is made that not all fluid ejectors have been tested, the control routine returns to step S4615, and repeats steps S4615 through step S4640 until all fluid ejectors have been tested.

Of course, in various exemplary embodiments, step S4645 may also contain a further routine where steps, including steps S4610 through step S4640, are re-applied to the selected fluid ejector to determine whether the alignment and/or performance control, routine, or application has sufficiently modified the selected fluid ejector.

In various exemplary embodiments, the apparatus of the invention may also include a modifying device. The modifying device may be used for wiping the fluid ejector's nozzle or other manipulation of the fluid ejector in order to modify the performance or alignment of the fluid ejector.

Alternatively, or in the event modification fails to adequately modify the fluid ejector's alignment or performance, defects in the image printed can be avoided through smart image processing or alternative print modes. Furthermore, if the modification process fails to adequately modify a selected fluid ejector the fluid ejector may be skipped during image processing.

While the invention has been described in conjunction with the specific embodiments outlined above, it is evident that many alternatives, modifications, and variations, will be apparent to those skilled in the art. For instance, while one skilled in the art of printing will apply the systems and methods to printing with ink, it is noted that the systems and methods of the invention apply to fluids other than ink. Accordingly, the exemplary embodiments of the invention as set forth above are intended to be illustrative and not limiting. Various changes may be made without departing from the spirit and scope of the invention as described herein.

What is claimed is:

1. An apparatus for controlling operation of at least one fluid ejector, the apparatus comprising:

at least one light emitting device that emits a light beam substantially perpendicular to a fluid ejector path;

at least one light detector positioned to receive the light beam from the at least one light emitting device and to provide an output indicative of receipt of the light beam; and a control device including:

a selection section that selects a set of at least one fluid ejector to be tested, an operating property determining section that determines an operating property of said at least one fluid ejector based on a detection signal of said at least one light detector, a compensation determining section that determines a preferred method from a plurality of methods of compensating problems associated with the at least one fluid ejector to restore the at least one fluid ejector towards an optimal performance level for use of said at least one fluid ejector during subsequent operation based on the operating property of said at least one fluid ejector determined by said operating property determining section, and a modification determining section that applies the preferred method of compensating said at least one fluid ejector determined by said compensation determining section for said at least one fluid ejector to control subsequent operation of said at least one fluid ejector.

2. The apparatus of claim 1, further comprising a lens system between said at least one light emitting device and said at least one light detector.

3. The apparatus of claim 1, further comprising an amplifier that amplifies the output from said at least one light detector.

4. The apparatus of claim 1, further comprising a modifying device that applies the preferred method of compensating said at least one fluid ejector to said at least one fluid ejector.

5. The apparatus of claim 1, wherein said light emitting device is a laser and said light detector is a photodiode.

6. The apparatus of claim 1, wherein said light emitting device is capable of movement in at least one plane.

7. The apparatus of claim 1, wherein said light detector is capable of movement in said at least one plane.

8. The apparatus of claim 1, wherein at least two light emitting devices are provided, each light emitting device being arranged to emit a light beam substantially perpendicular to each other light emitting device and to the fluid ejector path.

9. The apparatus of claim 8, wherein one of the at least two light emitting devices is oriented to detect vertical alignment of at least one drop from an array of fluid ejectors as an operating property of said fluid ejectors.

10. The apparatus of claim 8, wherein one of the at least two light emitters is oriented to detect horizontal alignment of at least one drop from an array of fluid ejectors as an operating property of said fluid ejectors.

11. The apparatus of claim 1, wherein the operating property detected is bi-directional alignment.

12. The apparatus of claim 1, wherein the operating property detected is tilt alignment.

13. The apparatus of claim 1, wherein the operating property detected is one of a blocked or misdirected nozzle.

14. The apparatus of claim 1, wherein the operating property detected is fluid kogation.

15. The apparatus of claim 1, wherein said control device further comprises:

a counter that counts a number of tested fluid ejectors of said set of fluid ejectors to be tested; and a counter determination section that determines whether a total number of said set of fluid ejectors to be tested has been tested.

16. The apparatus of claim 1, wherein said control device further comprises:

a timer that counts a period of time between testing of said set of fluid ejectors to be tested; and a timer determination section that determines whether a predetermined period of time has passed since said set of fluid ejectors to be tested has been tested.

17. The apparatus of claim 1, wherein said compensation determining section comprises:

a timer; and a timer determination section that determines whether fluid ejectors of said set of fluid ejectors have been idle for a predetermined period of time.

18. A method for controlling alignment and performance of a fluid ejector, comprising:

setting a first light emitting device to correspond with a first light detector in a first plane, such that a first light beam emitted from said first light emitting device may be received by said first light detector;

selecting a fluid ejector to be tested from a set of at least one fluid ejector to be tested;

providing said fluid ejector to be tested substantially perpendicular to said first light emitter;

emitting the first light beam from said first light emitting device;

ejecting at least one individual drop from said fluid ejector toward said first light beam;

determining whether said at least one individual drop impinged the first light beam by analyzing a first detection signal generated by said first light detector;

determining a first operating property of said fluid ejector based on the first detection signal generated by said first light detector;

determining a preferred method from a plurality of methods of compensating problems associated with the at least one fluid ejector to restore the fluid ejector towards an optimal performance level for use of said fluid ejector during subsequent operation based on said first operating property of said fluid ejector determined in the first operating property determining step, and applying the preferred method of compensating said fluid ejector determined in the preferred method determining step to control subsequent operation of said fluid ejector.

19. The method of claim 18, further comprising:

modifying said fluid ejector based on the preferred method of compensating said fluid ejector determined in the preferred method determining step.

20. The method of claim 18, further comprising:

modifying image data to be printed based on said preferred method of compensating said fluid ejector determined in the preferred method determining step.

21. The method of claim 18, further comprising:

setting a second laser emitting device in a second plane different from said first plane such that a second light beam emitted from said second light emitting device is received by a second light detector;

determining whether said at least one individual drop impinged the second light beam by analyzing a second detection signal generated by the second light detector;

determining a second operating property of said fluid ejector based on the second detection signal generated by said second light detector; and determining a preferred method of compensating said fluid ejector based on the second operation property of said fluid ejector determined in the second operating property determining step.

22. The method of claim 21, further comprising:

determining said preferred method of compensating said fluid ejector based on said first operating property and said second operating property of said fluid ejector.

23. A method for printhead alignment comprising:

setting a first light emitting device to correspond with a first light detector in a first plane, such that a first light beam emitted from said first light emitting device may be received by said first light detector;

selecting a set of at least two fluid ejectors on a printhead to be tested;

determining the position of a first fluid ejector to be tested based on a fiducia;

emitting the first light beam from said first light emitting device;

ejecting a first drop from said first fluid ejector;

determining whether said first drop impinged said first light beam by analyzing a first detection signal generated by said first light detector;

determining a first operating property of said first fluid ejector based on said first detection signal generated by said first light detector;

determining the position of a second fluid ejector to be tested based on said fiducia;

setting a second light emitting device to correspond with a second light detector in a second plane, such that a second light beam emitted from said second light emitting device may be received by said second light detector;

emitting the second light beam from said second light emitting device;

ejecting a second drop from said second fluid ejector;

determining whether said second drop impinged said second light beam by analyzing a second detection signal generated by said second light detector;

determining a second operating property of said second fluid ejector based on said second detection signal generated by said second light detector;

comparing the first operating property determined in the first operating property determining step and the second operating property determined in the second operating property determining step to determine a preferred method from a plurality of methods of compensating problems associated with the at least one fluid ejector to restore the fluid ejector towards an optimal performance level for use of said fluid ejectors during subsequent operation, and applying the preferred method of compensating said fluid ejectors, determined in the comparing step, to said fluid ejectors to control a subsequent printhead alignment operation of the fluid ejectors.

24. The method of claim 23 further comprising:

moving the light beam relative to the at least one fluid ejector.

25. The method of claim 23, wherein the fluid ejector includes an array of ejector nozzles, and the first and second operating properties are selected from the group of horizontal nozzle alignment, vertical nozzle alignment, tilt alignment, bi-directional alignment, missing droplets, and kogation.

26. A fluid ejector comprising:

a fluid head with an array of fluid ejectors; and the apparatus of claim 1.

27. An ink jet printer, comprising:

a printhead with an array of printhead nozzles serving as fluid ejectors; and the apparatus of claim 1.

* * * * *